US011273476B2

(12) United States Patent
Sollner

(10) Patent No.: US 11,273,476 B2
(45) Date of Patent: Mar. 15, 2022

(54) TREATMENT OF HOT ROLLING STOCK MADE OF METAL

(71) Applicant: Primetals Technologies Germany GmbH, Erlangen (DE)

(72) Inventor: Emmeran Sollner, Erlangen (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 0 days.

(21) Appl. No.: 17/270,904

(22) PCT Filed: Jul. 30, 2019

(86) PCT No.: PCT/EP2019/070503
§ 371 (c)(1),
(2) Date: Feb. 24, 2021

(87) PCT Pub. No.: WO2020/057824
PCT Pub. Date: Mar. 26, 2020

(65) Prior Publication Data

US 2021/0213499 A1 Jul. 15, 2021

(30) Foreign Application Priority Data

Sep. 18, 2018 (EP) ..... 18195234

(51) Int. Cl.
*B21B 15/00* (2006.01)
*B21B 1/16* (2006.01)
(Continued)

(52) U.S. Cl.
CPC ..... *B21B 15/00* (2013.01); *B21B 1/16* (2013.01); *B21B 37/007* (2013.01); *B21B 38/008* (2013.01)

(58) Field of Classification Search
CPC ..... B21B 15/00; B21B 1/16; B21B 37/007; B21B 38/008; B21B 2001/225
(Continued)

(56) References Cited

U.S. PATENT DOCUMENTS 3,550,419 A 12/1970 Fox et al.
3,592,051 A 7/1971 Kubo et al. ..... 73/67
(Continued)

FOREIGN PATENT DOCUMENTS

DE 1 901 941 A1 10/1969
JP H04-339505 A 11/1992
(Continued)

OTHER PUBLICATIONS

International Search Report dated Sep. 30, 2019 in corresponding PCT International Application No. PCT/EP2019/070503.
(Continued)

*Primary Examiner* — Gregory D Swiatocha
*Assistant Examiner* — Bobby Yeonjin Kim
(74) *Attorney, Agent, or Firm* — Ostrolenk Faber LLP

(57) ABSTRACT

Hot rolling stock (1) made of metal which is rolled in at least one roll stand (2) and then cooled in a cooling section (5) arranged downstream of the at least one roll stand (2). Sound generated by means of a sound generator arrangement (8) is coupled into the rolling stock (1) by a coupling device (1) so that a standing sound wave is formed at least in the region of the rolling stock (1) which is located in the vicinity of the coupling device (10).

7 Claims, 2 Drawing Sheets

(51) Int. Cl.
*B21B 37/00* (2006.01)
*B21B 38/00* (2006.01)

(58) Field of Classification Search
USPC ..... 72/710, 587; 148/558, 565
See application file for complete search history.

(56) References Cited

U.S. PATENT DOCUMENTS

| | | | | |
|---|---|---|---|---|
| 5,904,204 | A * | 5/1999 | Teraoka | C21D 8/0205 164/417 |
| 2015/0344984 | A1* | 12/2015 | Hua | C21D 11/005 148/558 |

FOREIGN PATENT DOCUMENTS

| | | | |
|---|---|---|---|
| SU | 734296 | A1 | 5/1980 |
| SU | 1398943 | A1 | 5/1988 |
| SU | 1764729 | A1 | 9/1992 |

OTHER PUBLICATIONS

Written Opinion dated Sep. 30, 2019 in corresponding PCT International Application No. PCT/EP2019/070503.
European Search Report dated Mar. 6, 2019 in corresponding European Patent Application No. 18195234.2.
Russian Federation Office Action, dated Nov. 10, 2021, issued in corresponding Russian Patent Application No. 2021106899/05(014869). English translation. Total 11 pages.

* cited by examiner

TREATMENT OF HOT ROLLING STOCK MADE OF METAL

CROSS-REFERENCE TO RELATED APPLICATIONS

The present application is a 35 U.S.C. §§ 371 national phase conversion of PCT/EP2019/070503, filed Jul. 30, 2019, the contents of which are incorporated herein by reference, which claims priority of European Patent Application No. 18195234.2, filed Sep. 18, 2018, the contents of which are incorporated by reference herein. The PCT International Application was published in the German language.

FIELD OF TECHNOLOGY

The present invention is based on a treatment process for hot rolling stock made of metal. The rolling stock is rolled in at least one roll stand and then cooled in a cooling section arranged downstream of the at least one roll stand.

The present invention is also based on a treatment device for hot rolling stock made of metal. The treatment device has at least one roll stand, in which the rolling stock is rolled. The treatment device has a cooling section, which is arranged downstream of the roll stand and in which the rolling stock is cooled.

PRIOR ART

Such treatment processes and associated treatment devices are generally known. Also generally known are finishing trains in which a flat rolling stock of this type, for example a rolling stock made of steel or aluminum, is rolled. Each finishing train has a downstream cooling section, in which the metallurgical properties, and consequently the mechanical properties, of the rolling stock are set.

In the prior art, it is endeavored in this respect to arrange the cooling section as close as possible after the last roll stand of the rolling train, in order that the cooling can begin as quickly as possible. In the cooling section, the setting of the mechanical properties of the rolling stock usually takes place by applying an exactly adjusted amount of water from above and below and in exceptional cases, only from above or only from below. In particular, it is important that the rolling stock cools down with a temperature profile (as a function of time) that is as exactly correct as possible. This particularly influences the grain structure of the rolling stock.

SUMMARY OF THE INVENTION

The object of the present invention is to create possible ways in which the grain structure of the rolling stock can be additionally influenced.

The object is achieved by a treatment process with the features disclosed herein.

According to the invention, a treatment process of the type mentioned above is distinguished by coupling sound generated by a sound generator arrangement into the rolling stock by means of a coupling device, so that a standing sound wave is formed at least in the region of the rolling stock that is located in the vicinity of the coupling device.

The standing sound wave leads to mechanical movements (albeit only slight) of the flat rolling stock at the frequency of the sound wave at some points of the rolling stock. Those points are specifically wherever the so-called antinodes of the sound wave are located. At other points, specifically where the so-called nodes of the standing sound wave are located, there is no such movement of the flat rolling stock. The points on the rolling stock at which the antinodes are located consequently lead to a movement in relation to the points of the rolling stock at which the nodes are located. These relative movements influence the increase in grain size of the rolling stock, to be precise, both the beginning of the increase in grain size and the rate of the increase in grain size. The process is similar to an example of sodium acetate trihydrate, which remains liquid well below its melting point until the phase transformation into a solid can be initiated by a sound pulse. By choosing a suitable frequency and a suitable amplitude of the standing sound wave, a specific influence can consequently be brought to bear on the grain size. The sound generator arrangement may have a single sound generator or a number of sound generators, according to requirements. The sound generators may for example be designed as so-called transducers.

The sound preferably has a frequency in the MHz range or above. In particular, the propagation rate of the sound lies in the range of about 5000 m/s in the case of steel, and even above 6000 m/s in the case of aluminum. At an assumed frequency of 50 MHz, a wavelength of about 0.1 mm is consequently obtained in the case of steel, and a wavelength of about 0.08 mm in the case of aluminum. At an assumed frequency of 500 MHz, the wavelength is correspondingly shorter and is about 10 μm and about 8 μm, respectively. The grain sizes are also of such orders of magnitude.

The sound generator arrangement may be possibly uncontrolled, possibly except for a switching signal for switching it on and off. However, the sound generator arrangement is preferably fed at least one control variable by a control device. In this case, the sound generator arrangement sets a characteristic quantity of the sound coupled into the rolling stock in dependence on the control variable. As a result, a specific setting of the effect caused by the standing sound wave can be realized.

The characteristic quantity may be a frequency and/or an amplitude of the sound and/or, if the sound generator arrangement has a number of sound generators which each independently couple a sound signal into the rolling stock, that is a phase position of the sound signals of the sound generators in relation to one another.

The control device preferably determines the at least one control variable in dependence on actual properties of the rolling stock before it reaches the cooling section and/or on setpoint properties that the rolling stock is intended to have after passing the cooling section. The temperature and the dimensions of the rolling stock, for example for a flat rolling stock, its width and its thickness, come into consideration as actual properties of the rolling stock preceding the cooling section. Desired mechanical or metallurgical or microcrystalline properties of the flat rolling stock come into consideration as setpoint properties.

It is theoretically possible to couple the generated sound into the rolling stock without contact, by way of an air gap. However, coupling in by a means involving contact has considerably better efficiency. It is possible that the coupling device is a working roller of the last roll stand before the cooling section. In this case, the implementation of the treatment process is particularly simple, since no additional device is required. Alternatively, it is possible that the coupling device is a roller that is arranged between the last roll stand and the cooling section and is placed against the rolling stock. This design has the advantage that the coupling device can be optimized specifically for the coupling in of the sound. Other locations may also be appropriate for coupling in the sound, for example a point between the last-but-one roll stand and the last roll stand of the rolling train, a point within the cooling section or a point after the cooling section, possibly before a coiler arranged downstream of the cooling section.

The rolling stock may in principle be of any desired shape. In many cases, however, the rolling stock is a flat rolling stock, in particular a strip.

The object of the invention is achieved by a treatment device disclosed herein.

According to the invention, a treatment device of the type mentioned at the beginning is designed such that the treatment device has a sound generator arrangement, by means of which sound is generated. It is also designed such that the treatment device has a coupling device, by means of which the sound generated by means of the sound generator arrangement is coupled into the rolling stock. This forms a standing sound wave at least in the region of the rolling stock that is located in the vicinity of the coupling device.

The advantages that can be achieved as a result correspond to those of the treatment process. The advantageous designs of the treatment device correspond to the designs of the treatment process. The advantages that can be achieved with these are also the same as in the case of the designs of the treatment process.

BRIEF DESCRIPTION OF THE DRAWINGS

The properties, features and advantages of this invention described above and also the manner in which they are achieved become clearer and more clearly understandable in connection with the following description of the exemplary embodiments, which are explained more specifically in conjunction with the schematically represented drawings, in which.

DESCRIPTION OF THE EMBODIMENTS

Figure 1:
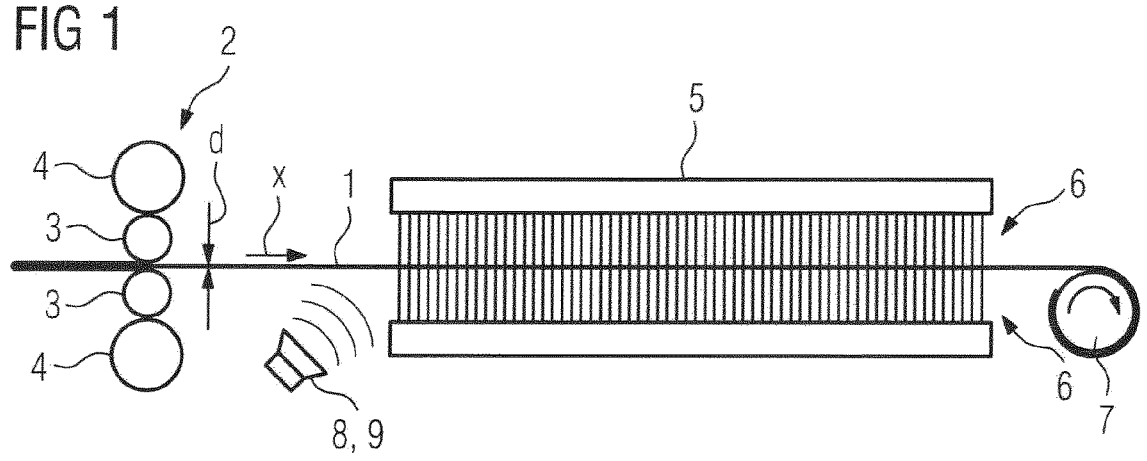
FIG. 1 shows a treatment device for a rolling stock.

According to FIG. 1, a hot rolling stock 1 made of metal is rolled in a roll stand 2. The hot rolling stock 1 runs through the rolling stand 2 in a transporting direction x. The hot rolling stock 1 may for example consist of steel. In this case, the temperature T of the hot rolling stock 1 when it leaves the roll stand 2 is usually between 750° C. and 900° C. Alternatively, the hot rolling stock 1 may consist of aluminum. In this case, the temperature T of the hot rolling stock 1 when it leaves the roll stand 2 is generally between 300° C. and 400° C. The hot rolling stock 1 may also consist of some other metal, for example copper. Then the metal in this case is at a material-specific temperature.

Figure 2:
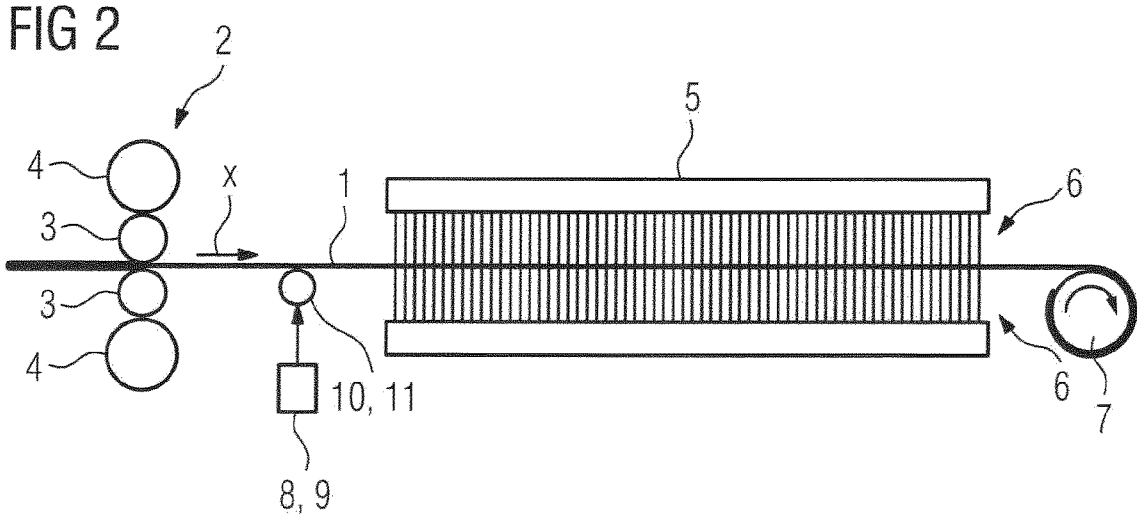
FIG. 2 shows a design of a second treatment device of FIG. 1.

Often, before the rolling in the roll stand 2 shown in FIG. 2, the hot rolling stock 1 is rolled in further roll stands arranged upstream of the roll stand 2. The further roll stands are not included in FIG. 1.

The hot rolling stock 1 may in principle have any desired cross section. In many cases, the hot rolling stock 1 is a flat rolling stock, in particular a strip. Accordingly, the roll stand 2 is formed as a roll stand for rolling the flat rolling stock 1. In particular, the roll stand 2 may in this case have back-up rolls 4 in addition to its working rollers 3.

After the rolling in the roll stand 2, the rolling stock 1 continues to be conveyed in the transporting direction x, and therefore runs through a cooling section 5 arranged downstream of the roll stand 2. If the hot rolling stock 1 is a flat rolling stock, the cooling section 5 is formed as a cooling section for cooling the flat rolling stock 1. In the cooling section 5, the rolling stock 1 is cooled by liquid cooling medium 6, usually water, being applied to it. In a way corresponding to the representation in FIG. 1, the cooling medium 6 is generally applied from more than one side, for example, for a flat rolling stock, both from above and from below. In principle, however, cooling from only one side is also possible. For example, for a flat rolling stock, cooling may be exclusively from above or exclusively from below. After the cooling section 5, the hot rolling stock 1 is at a much lower temperature than before it passes the cooling section 5. For example, in the case of steel, the temperature may be lowered to about 300° C.

Further devices may be arranged downstream of the cooling section 5, for example a coiler 7, by which the rolling stock 1 is coiled up, if it is a strip.

Figure 3:
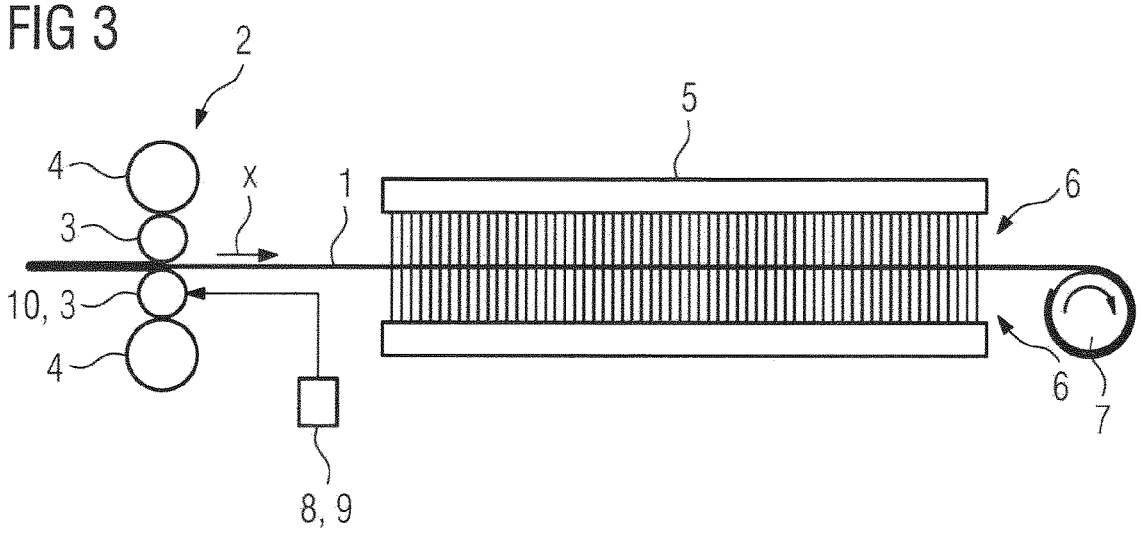
FIG. 3 shows a third design of the treatment device of FIG. 1.

A sound generator arrangement 8 generates sound. For this purpose, the sound generator arrangement 8 has a plurality of sound generators 9, for example transducers. The sound is coupled into the hot rolling stock 1 by a coupling device 10. Corresponding to the representation in FIG. 2, the coupling device 10 may, for example, be a roller 11, which is arranged between the roll stand 2 and the cooling section 5 and is placed against the hot rolling stock 1. Alternatively, in a way corresponding to the representation in FIG. 3, the coupling device 10 may be a working roller 3 of the last roll stand 2. It is similarly possible to couple the sound into the hot rolling stock 1 at other points in the transportation of the rolling stock. In particular, coupling in before the roll stand 2, in the cooling section 5, or after the cooling section 5 is also possible.

Figure 4:
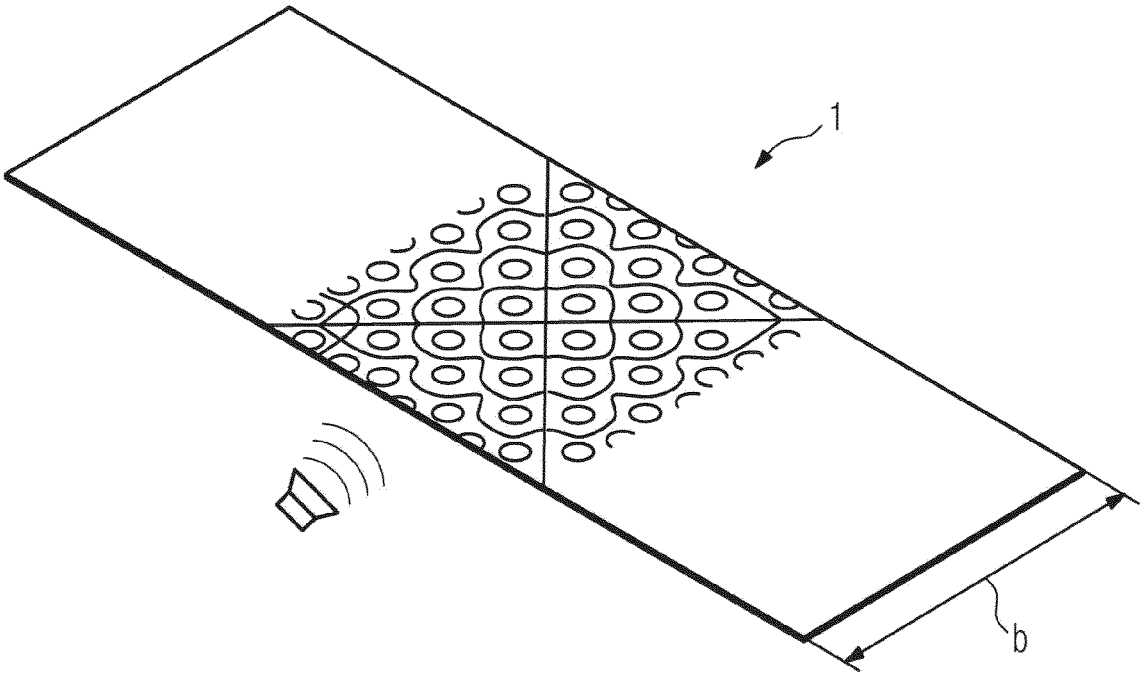
FIG. 4 shows a portion of a flat rolling stock.

The coupled-in sound has the effect of forming a standing sound wave, at least in the region of the hot rolling stock 1, that is located in the vicinity of the point at which the sound is coupled into the hot rolling stock 1. FIG. 4 shows this by example for a flat rolling stock. The lines and circles depicted in FIG. 4 indicate those points at which the nodes of the standing sound wave are located, and at which extinction of the sound wave therefore occurs as a result of destructive interference. In between the nodes are the points at which the sound wave is not extinguished, and in particular at some points is at a maximum because of constructive interference.

In many cases, the point at which the sound is coupled into the hot rolling stock 1 is chosen such that a standing sound wave is formed at least between the roll stand 2 and an entry region of the cooling section 5. In some cases, however, other points may also be appropriate.

The sound wave has the effect of influencing the microstructural transformation of the hot rolling stock 1. In particular, the microstructure becomes more fine-grained based on the greater the frequency f of the coupled-in sound, and consequently also of the standing sound wave, is. The frequency f of the coupled-in sound should therefore lie in the MHz range or above, or the sound generator arrangement 8 should be correspondingly formed, to correspond to such a frequency.

The sound generator arrangement 8 is preferably formed as a sound generator arrangement that can be set. In this case, corresponding to the representation in FIG. 5, the sound generator arrangement 8 may be fed at least one control variable C by a control device 12 of the treatment device. In this case, the sound generator arrangement 8 sets a characteristic quantity f, A, φ of the sound coupled into the hot rolling stock 1 in dependence on the control variable C.

Figure 5:
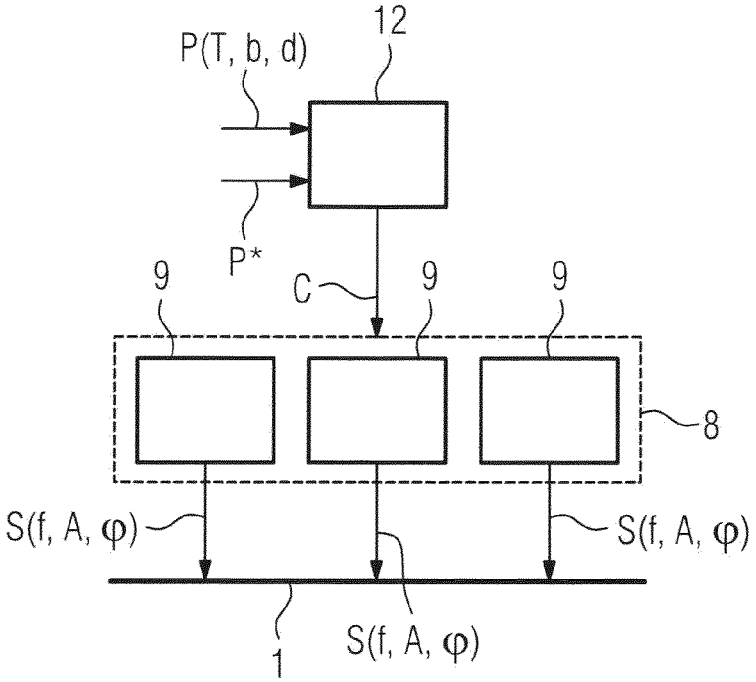
FIG. 5 shows a control device and a sound generator arrangement.

For example, corresponding to the representation in FIG. 5, the control device 12 may specify to the sound generator arrangement 8, by means of a control variable C, which frequency f the sound is to have. As an alternative or in addition, the control device 12 may specify to the sound generator arrangement 8 by means of another control variable C which amplitude A the sound is to have. Corresponding to the representation in FIG. 5, if the sound generator arrangement 8 has a plurality of sound generators 9, which each independently couple a sound signal S into the hot rolling stock 1, the amplitude A may possibly be specified individually for the respective sound generator 9 by means of a respective control signal C. For a plurality of sound generators 9, the control device 12 may furthermore also specify to the sound generators 9 of the sound generator arrangement 8, by a respective control variable C, a phase position φ of the sound signals S of the sound generators 9 in relation to one another. This is an alternative or in addition to the influencing of the frequency f and/or the amplitude A. By contrast, the frequency f is generally the same for all sound generators 9.

The at least one control variable C may be determined by the control device 12, according to requirements. For example, actual properties P of the hot rolling stock 1 before the cooling section 5 may be specified to the control device 12. The actual properties P of the hot rolling stock 1 before the cooling section 5 may, for example, be its temperature T and/or at least one geometrical dimension. On a flat rolling stock, the dimension may be its width b or its thickness d (see also FIGS. 1 and 4). As an alternative or in addition, setpoint properties P*, which the hot rolling stock 1 is intended to have after the cooling section 5, may also be specified to the control device 12. The setpoint properties P* may, for example, be desired mechanical properties such as tensile strength, elongation limit, fracture limit, etc. or microcrystalline properties, s for example, fractions of bainite, martensite and the like. The control device 12 in this case determines the control variable C in dependence on the properties P, P* specified to it.

The present invention has many advantages. In particular, it is easily possible when cooling down the hot rolling stock 1 to additionally influence the microstructural transformation independently of the cooling. The microstructural properties of the rolling stock 1 can be improved, set more precisely and especially made more uniform. The construction of the cooling section 5 can be simplified. The distance from the last roll stand 2 can be increased without any problem.

Although the invention has been illustrated more specifically and described in detail by the preferred exemplary embodiment, the invention is not restricted by the examples disclosed and other variations may be derived therefrom by a person skilled in the art without departing from the scope of protection of the invention.

LIST OF DESIGNATIONS

1 Rolling stock
2 Roll stand
3 Working rollers
4 Back-up rolls
5 Cooling section
6 Cooling medium
7 Coiler
8 Sound generator arrangement
9 Sound generators
10 Coupling device
11 Roller
12 Control device
A Amplitudes
b Width
C Control variable
d Thickness
f Frequency
P Actual properties
P* Setpoint properties
S Sound signals
T Temperature
x Transporting direction
φ Phase positions

The invention claimed is:

1. A treatment process for hot rolling stock made of metal, the process comprising:

rolling the rolling stock in at least one roll stand;

cooling the rolling stock in a cooling section arranged downstream in a direction of the rolling of the rolling stock of the at least one roll stand;

providing a sound generator arrangement;

providing a control device;

operating the control device to determine at least one control variable (C) based on actual properties (P) of the rolling stock before cooling in the cooling section and based on set point properties (P*) that the rolling stock is to have after cooling in the cooling section;

feeding the sound generator arrangement the at least one control variable (C);

generating sound by the sound generator arrangement and coupling the generated sound into the rolling stock upstream of the cooling section for forming a standing sound wave at least in a region of the rolling stock that is located in a vicinity of a coupling device; and operating the sound generator arrangement to set a characteristic quantity of the sound coupled into the rolling stock based on the control variable (C).

2. The treatment process as claimed in claim 1, further comprising:

generating the sound at a frequency (f) in the MHz range or above.

3. The treatment process as claimed in claim 1, wherein the characteristic quantity (f, A, φ) is a frequency (f) and/or an amplitude (A) of the sound if the sound generator arrangement comprises a plurality of sound generators and if each sound generator independently couples a sound signal (S) into the rolling stock, for setting a phase position (φ) of the sound signals (S) of the sound generators in relation to one another.

4. The treatment process as claimed in claim 1, further comprising the coupling device comprises a working roller of a last one of the roll stands before the cooling section or comprises a roller that is arranged between the last one of the roll stands and the cooling section, and the process comprising placing the last one of the roll stands against the rolling stock.

5. The treatment process as claimed in claim 1, wherein the rolling stock is a flat rolling stock.

6. The treatment device as claimed in claim 5, wherein the flat rolling stock is a strip.

7. The treatment process as claimed in claim 3, further comprising:

if the sound generator arrangement comprises a plurality of sound generators which each independently couples a sound signal (S) into the rolling stock, setting a phase position (φ) of the sound signals (S) of the sound generators in relation to one another.

* * * * *